United States Patent [19]

Kirchhan

[11] Patent Number: 4,712,685

[45] Date of Patent: Dec. 15, 1987

[54] CONTAINERIZED SHOCK MOUNT

[76] Inventor: James J. Kirchhan, 23912 Flores Ave., Laguna Niguel, Calif. 92677

[21] Appl. No.: 904,343

[22] Filed: Sep. 5, 1986

[51] Int. Cl.[4] ..... B65D 81/10

[52] U.S. Cl. ..... 206/591; 220/4 B; 220/80; 220/81 R

[58] Field of Search ..... 220/4 B, 80, 81 R; 206/524.8, 521, 594, 591, 592

[56] References Cited

U.S. PATENT DOCUMENTS

| | | | |
|---|---|---|---|
| 2,928,535 | 3/1960 | Simmons et al. | 206/591 X |
| 2,933,183 | 4/1960 | Koelsch | 206/591 X |
| 3,943,987 | 3/1976 | Rossi | 206/524.8 X |
| 4,546,874 | 10/1985 | Kirchhan | 220/80 X |

FOREIGN PATENT DOCUMENTS

| | | | |
|---|---|---|---|
| 2106249 | 4/1983 | United Kingdom | 206/521 |
| 603611 | 4/1978 | U.S.S.R. | 206/594 |

*Primary Examiner*—William Price

*Attorney, Agent, or Firm*—George F. Bethel; Patience K. Bethel

[57] ABSTRACT

The disclosure herein sets forth an equipment shock mounting means for utilization with a container formed of plastic. The shock mounting means comprises a rigidified outer frame structure which can be formed as a portion of the edge regions of said container portions. The edge regions of the container portions can be formed with channel members which are suited to match each other so that when they come together they form a complete closure. Attached to the channel members are shock mounts extending interiorly and supporting an equipment shock mount structure for equipment to be mounted thereon. As an alternative, the edge region channel members can be substituted for mounting the shock mounts in the way of a frame member. The shock mounts extend inwardly to support the equipment shock mount means and receive equipment thereon. In this manner, the entire shock mount structure can be removed and used as a supporting carriage for the equipment and the container can be used both with and without the shock mount means of this invention.

20 Claims, 6 Drawing Figures

CONTAINERIZED SHOCK MOUNT

BACKGROUND OF THE INVENTION

1. Field of the Invention

The field of this invention resides within the art of containers that are moisture proof to provide a moisture proof environment for items placed therein. The specific field is with regard to containers having edge regions that seal the container together and provide a shock mount for materials implaced within the container. The shock mount can be in any particular form so long as it is attached to the container in a manner that will cradle and cushion the contents that are mounted therein.

2. The Prior Art

The prior art of containers that are substantially moisture proof and provide shock mounts has varied. A container of note is that of the inventor hereof, namely that shown in U.S. Pat. No. 4,546,874 as patented Oct. 15, 1985. The inventor herein invented the foregoing container specifically to enhance the sealing of the container as described therein. That container has been well suited and found substantial acceptance within the art. However, in some cases when shock mounts were used, the container has been found wanting.

Other containers of the prior art that have stock mounts therein have not provided adequate shock proof isolation to materials held by the mounts.

Such containers are often utilized to hold and seal from moisture items such as electronic and mechanical instrumentation. These items can be delicate instruments such as gyroscopes.

When the foregoing instrumentation was maintained in prior art containers by certain shock proofing means, the isolation has not been adequate. In particular, shock proofing has been attempted by means of foam. However, when foam is utilized, the foam is oftentimes compressed and retains a compression set. In effect, the equipment to be isolated lying on the foam within the container has pushed the foam into a compressed relationship. This compressed relationship has been set to the extent wherein it no longer provides any cushioning. In effect, the weight of the material on the foam has pushed it down and the foam has maintained this form after an extended period of time. This, of course, causes the foam to not provide the resilient shock proofing that is necessary.

Another type of shock mounting or shock proofing for materials in a container has involved the utilization of elastomeric rigidified shock absorbers or mounts. The shock mounts pass through the container causing leaks within the plastic material of the container. In addition thereto, the shock mounts tend to enlarge the openings through which they pass into the container by virtue of the metal to plastic relationship which is not retained as to its original inside and outside dimensions.

Thus, the very nature of the container's requirements as to moisture proofing are destroyed by the shock mount passing through the plastic into the container. If effectively causes a deterioration of the plastic seal around the shock mount, thereby allowing moisture to seep into the container.

A further problem with regard to prior art shock mountings is that they do not contribute to a rigidified container structure. The shock mount supporting structure is such wherein it deforms upon impact. This is due to the fact the mounts are attached to a plastic container. When the plastic container deforms, regardless of the fact that a metal shock mount has been attached to the container, the mount itself no longer absorbs the shock. This is due to the fact that the deformation of the plastic container to which the shock mount is attached, creates a situation wherein shocks are transmitted directly to the material which is to be protected from shocks. This in turn causes a situation to evolve wherein the basic function of the shock mount no longer takes place, or at the best provides erratic and inconsistent shock protection.

Many shock mounts are provided within a container's corner regions through the plastic container. The fit between the opening and the mount can deteriorate with time as to moisture transmission. Furthermore, when the corners are impacted, the non-rigid nature of the plastic allows a deformation and skewing or offsetting of the shock mount frame. This attendantly causes a shock to be transmitted to the material which is to be protected, thereby obviating the important function of shock mounting.

This invention overcomes the problems of the prior art in numerous ways. One of the most important ways is the fact that it attaches the shock mounts to a specific metal structure which does not substantially deform. This metal structure allows the bolts of the shock mounts to pass therethrough and be sealed without deterioration over time due to expansion of the opening or hole in the plastic through which the shock mount bolt passes.

This invention is further enhanced by virture of the fact that the shock mount is mounted to a metal frame. The metal frame is rigid and does not deform as in the manner of the prior plastic container to which the mounts are attached. This thereby contributes to the overall shock absorbing and shock isolation characteristics which avoids the problems attendant with deformation of prior art containerized shock mounts.

Another important feature of this invention is the fact that the shock mounts thereof can be mounted on a portable frame. The frame can be handled as a structure holding the equipment to be protected in any processing or setting up prior to being containerized. Thus, the frame allows for the removal or implacement of the equipment to which it is attached into the container without removal of the equipment from the shock mounting frame.

Another significant feature is the fact that the frame of this invention which holds the shock mounts can be utilized to retrofit existing containers. Such containers can be mounted with the shock mount means of this invention or used for other purposes that do not require shock mounts. Thus, the frame can be implaced or withdrawn from a container, making the container a multipurpose container for containing both items to be shock mounted and those items which are to be merely implaced in the container without a shock mount.

SUMMARY OF THE INVENTION

In summation, this invention comprises a moisture proof container formed of plastic or sheet aluminum having a holding means or structure mounted to the sides of the container by means of rubber shock mounts and a rigidified metal structure or frame to prevent deformation of the container.

More particularly, it involves the utilization of a plastic container. The plastic container can be formed with a hinge and certain closures allowing the opening and closure of the container. Internally of the container, a piece of equipment such as a delicate instrument is to be maintained in moisture proof and shock conditioned relationship.

The foregoing shock conditioned relationship is provided by means of shock mounts. The shock mounts pass through a metallized frame portion of the peripheral area of the container. This peripheral area of the container incorporates a frame structure with the shock mounts passing through the frame structure held by means of bolts.

The bolts are used to hold the shock mounts which are attendantly connected to equipment mounting means or structure such as rails, a platform or other equipment holding devices.

The equipment holding device or structure is held within the external frame or rigidified portion in a manner so that shocks transmitted to the plastic container material will not deform it and thereby lessens the amount of shock to the equipment being held by the internal shock mounting structure.

Another important feature of the frame hereof can be utilized to hold an internal shock mounting structure external to the container. This facilitates handling and general accommodation of the material being held in the container when it is removed therefrom. In addition thereto, it allows a retrofit of existing containers so that the shock mounting frame can be utilized and implaced within an existing container not having shock mounts. Also, it allows a multiple usage of containers with and without shock mounting means as shall be described hereinafter.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
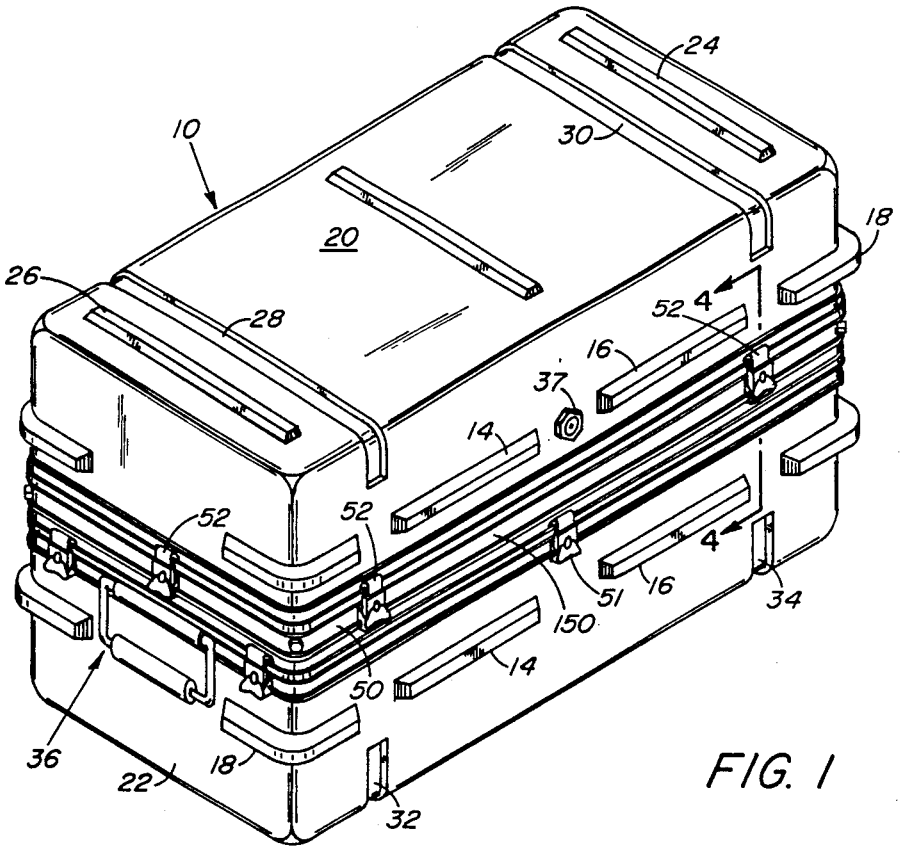
FIG. 1 shows a perspective view of a closed container of this invention with a shock mount frame being held at the interfacing top and bottom portions thereof.

Looking at FIG. 1, it can be seen that a container 10 is shown. The container can be made of a plastic, metal such as aluminum or even steel. In this case, it is preferably made out of a plastic material which is formed through certain standard molding operations. Such molding can take place by blow molding, rotational molding, compression molding, hand layup, fiberglass molding, or any other kind of forming operation. Preferably, the material from which the container is made is from a plastic of the olefin family. Such plastics such as polyethylene can be utilized in this particular case.

It is preferred that a high molecular weight or density polyethylene be utilized. The high molecular weight polyethylene generally prevents crazing and cracking due to the increased density. The high molecular weight material helps to prevent the cracking as well as performing the function of preventing the passage of moisture into the container 10.

It should be understood that the container in this particular instance is generally used for sealing parts and moisture therefrom. It should be formed of a material that is not hydroscopic in order to eliminate the transmission of moisture therethrough.

Oftentimes, these containers are used to seal such items as electronic and mechanical instrumentation. Such instrumentation is required to be kept in a moisture free environment for both industrial and military usage. Accordingly, the prevention of the transmission of moisture is extremely important in this case and the design of the container from the standpoint of the transmissibility of the plastic is an important consideration herein.

Another substantial consideration is the fact that the equipment to be held in the container is to be isolated by shock mounts. The particular shock mounting is of a particular type and nature to avoid imparting shocks from the external portion of the container inwardly to the equipment mounted and held therein.

Looking more particularly at the container, it can be seen that a number of reinforcing members and bumpers have been provided. These reinforcing members and bumpers are generally shown as bumpers 14, 16, and corner bumpers 18. The bumpers are provided at respective top and bottom portions 20 and 22. The top and bottom in this particular case is only for convention purposes in order to provide an example in FIG. 1. However, as can be understood, the container 10 can be turned in various directions wherein the top can be the bottom and the bottom can be the top.

A pair of indexing ridges 24 and 26 are shown. The indexing ridges 24 and 26 index to channels or grooves in the bottom portion 22. This allows for stacking and holding of the container 10 in a stacked condition to avoid sliding of one on top of the other.

For greater security of items within the container 10, a pair of banding channels 28 and 30 on the top 20 are shown and channels 32 and 34 on the bottom 22. These banding channels allow a band to circumscribe the container 10 in order to hold the top and bottom portions of the container respectively members 20 and 22, in tightened orientation, and for holding two or more containers together.

In oder to provide facile movement of the container 10 a handle 36 is shown. The handle 36 is pivotally mounted on a mounting bracket and can be pivoted upwardly in order to provide lifting of the container 10.

Figure 2:
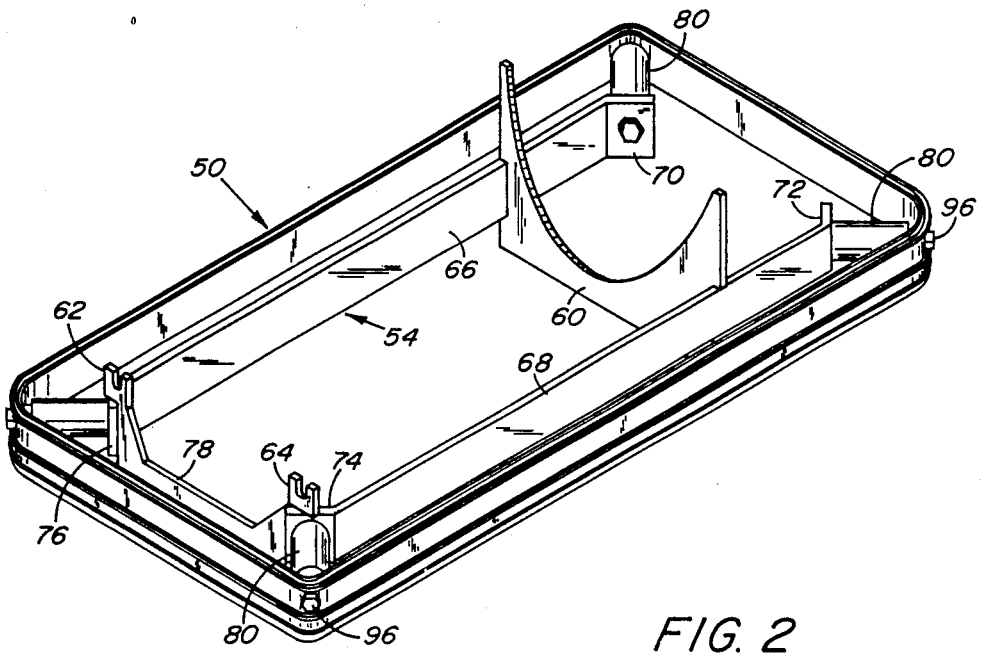
FIG. 2 shows a perspective view of the frame with the shock mount structure removed in the entirety from the container.

Looking more particularly at FIG. 2, it can be seen wherein a frame member 50 is shown. The frame member 50 is formed from an aluminum extrusion or it can be formed of any other type of metal. It can be a unified structure or rigidified in a manner whereby it is formed in a continuum and then welded after it is formed into its generally rectangular frame section.

A number of cam lock or overcenter hook members 52 are provided in order to lock the frame member 50 into position. For purposes of explanation, in FIG. 2 the cam lock or overcenter latches 52 are not shown but will be exemplified in the detailed showing of FIG. 4.

The frame 50 is such wherein it supports a shock mount equipment structure or cradle 54. The shock mount equipment structure or cradle 54 can be of any suitable configuration such as a tray, barrel, tubular support, concavity, rails, plates, or any other configuration in order to hold a piece of equipment therein. In this particular case, the shock mount structure 54 has been provided to hold a large rounded portion of equipment in a yoke 60. The equipment is also held by two slotted bolt mounts 62 and 64.

The equipment shock mount structure 54 comprises in this particular case two rails 66 and 68. The rails 66 and 68 have angular corner portions extending at a 45° angle at one end, namely, angular portions 70 and 72. These angular portions 70 and 72 are also incorporated at the other end of the rails 66 and 68 in the way of angular portions 74 and 76. The angular portions 74 and 76 are bridged by a cross member 78 which is secured thereto and carries the respective bolt mount slot brackets 62 and 64.

It should be understood that the foregoing equipment structure 54 is for example only. Various structures in the way of trays, cylinders, and other members can be attached to the frame 50 in the same manner as the structure 54. Therefore, when used in this application, equipment mounting structure or cradle 54 or similar equipment shock mounting structure(s), equipment structure or shock mount structure, or analogous terms will be the language incorporated herein for purposes of defining the mounting structure or cradle as being that portion which interfaces with the equipment to be held.

The shock mount structure 54 is held by shock mounts 80 at each corner of the frame 50. The shock mounts 80 comprise cylindrical members which can be generally seen in FIG. 6. The shock mounts 80 in particular are formed of elastomeric portions such as a rubber cylinder 86. The rubber cylinder 86 is formed with two hemispherical metal members 88 and 90. The hemispherical members 88 and 90 are molded into the rubber 86. Each hemispherical member 88 and 90 has respective female threads 92 and 94. The female threads 92 and 94 receive bolts 96 and 98. The bolts 96 and 98 pass through the frame 50 into the hemispherical metal portions 88. They also pass through the structure 54 at the angular members 70, 72 and 74 and 76 in order to secure the frame structure 50 to the shock mount structure or cradle 54.

Thus, the shock mount structure 54 is isolated from the frame 50 by means of the elastomeric portion of the shock mounts, namely elastomeric portions 86. Various types of shock mounts 80 can be utilized and it is not necessary to use these particular types of shock mounts. However, these shock mounts have fine absorptive characteristics within the elastomer 80. Thus, shocks seen at the outer portion or frame 50 are not readily transmitted into the shock mount support structure 54. To the contrary, they are substantially isolated by the shock mounts 80, and absorption of shocks takes place within the elastomer 86 of the shock mount 80. Such mounts can be plastic, or metal springs, leaf or coil springs, elastomeric blocks, or even pneumatic and fluid shock absorbers and cylinders. However, any suitable elastomeric or resilient shock mount analogous to shock mount 80 can be used.

In order to secure the shock mount 80 in tightened juxtaposition between the frame 50 and shock mount structure 54, the screws 96 and 98 can be turned so as to draw the respective hemispheric members 88 and 90 into a degree of resilient relationship with the elastomer 86 as required.

In order to provide spacing, a plurality of washers, or a large washer or spacer 100 can be utilized to isolate the shock mount 80 from the interior of the frame 50.

Figure 4:
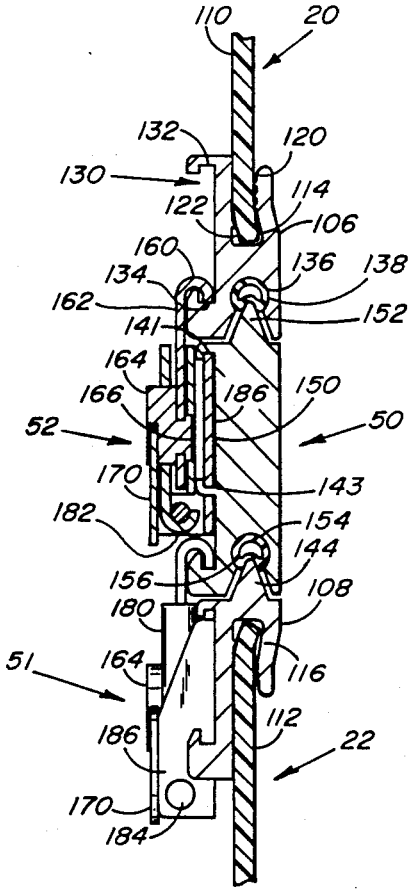
FIG. 4 is a view looking in the direction of lines 4—4 as a sectional view through the metal frame and container thereof.
Figure 5:
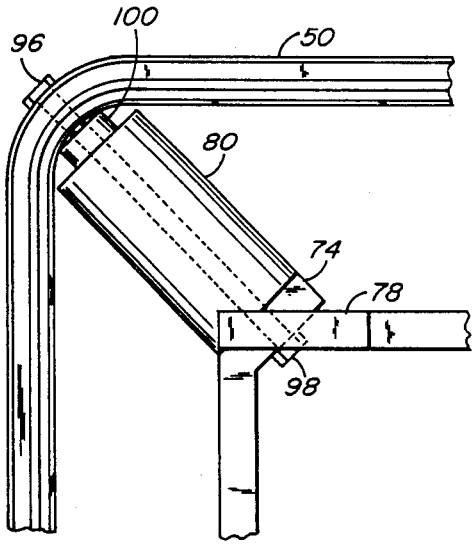
FIG. 5 is a view looking downwardly on the shock mount and frame in the corner of FIG. 3 closest to the viewer.

Looking more particularly at FIG. 4 which is a sectional view in the direction of lines 4—4, it can be seen wherein an overcenter or cam lock 52 is shown. The overcenter cam lock 52 is connected to the frame 50. The frame 50 is mounted between two peripheral edge channels connected to the top 20 and the bottom 22.

In particular, edge channels 106 and 108 are shown that receive the plastic wall portions of the top and bottom 20 and 22. They receive wall portion 110 and wall portion 112 in respective channels or slots 114 and 116. The channels or slots 114 and 116 have been described substantially within U.S. Pat. No. 4,546,874 as previously mentioned herein.

A brief explanation thereof is such wherein the edge channel members 106 and 108 are formed from an aluminum or other metal extrusion. The metal extrusion comprises channel openings 114 and 116 which receive the plastic walls at the top and bottom, namely plastic walls 110 and 112. A pair of tangs or continuous elongated barbs are provided, namely barbs 120. These barbs tend to engage the wall portion 110 and offset it against another barb 122 so as to bend the wall portions 110 and 112. This offset creates a cold flow of the plastic of the wall portions 110 and 112 so that a seal is maintained. Furthermore, in order to enhance the seal, an adhesive is implaced within the channel openings 114 and 116.

The edge channels 106 and 108 as to their entire structure are formed with an outer peripheral channel 130. The outer peripheral channel 130 has undercuts at either side. The undercuts can be seen specifically in the edge channel 106.

The edge channels 106 and 108 are similar to each other as to their outer channel portions 130 and their respective undercuts which shall be defined as undercuts 132 and 134. However, channel member 106 has a circular channel 136 that receives an elastomeric gasket 138. Edge channel member 108 has the undercuts 132 and 134 in the outer peripheral channel 130. It has a cross sectionally pointed pyramidal or triangular cross sectional shaped portion with a rounded top. This has been designated as triangularly shaped member 144.

When the frame 50 is not utilized, the pyramidal portion 144 is received against the elastomeric gasket 138 in order to seal the bottom channel member 108 against the top channel member 106. When the frame member 50 is not utilized, a direct seal takes place between peripheral edge channels 106 and 108 by the triangular bead or member 144 seating against the gasket 138. Thus, the container as will be appreciated hereinafter, can be used with and without the frame 50.

In the particular showing, the frame 50 has been shown interposed between the two edge channels 106 and 108 and locked by means of the cam lock 52 which will be expanded upon hereinafter.

Looking more particularly at the frame member 50 it can be seen wherein it comprises a peripheral channel portion 150 surrounding it. The peripheral channel portion 150 is formed within an extruded member having a triangular portion or tongue 152 at the upper portion having a rounded edge which in this case is seated against the gasket 138. At the lower portion, it has a circularly shaped channel 154 circumscribing a gasket 156 analogous to the channel and gasket members 136 and 138. In this manner, the triangular portion 144 can seat against the gasket 156. This allows a locking of the respective members into their relationship with each other with a sealing action.

The cam locks 52 which provide the locking comprise a hook portion 160. The hook portion 160 is formed with a downwardly projecting operator portion 162. The downwardly projecting operator portion has a slot overlying a rotatable disk 164. The rotatable disk 164 has a stainless steel pin 166 offset from the axis of the disc passing therefrom through the slot of the downwardly projecting operator portion 162. This pin 166 moves within the slot of the downwardly projecting operator portion 162 whereby the slot with receipt thereof is cammed upwardly and downwardly as the disk 164 is turned. Disk 164 is connected to a handle 170 so that it can be moved upwardly and downwardly by a rotation of the handle 170.

In order to hold the depending operator portion 162 in place, it moves within a channel formed by a pair of side walls turned onto portion 162 and is shown as a channel member 180 having a lower curved portion 182 which is hooked around a pin 184 supported on a bracket 186. In order to mount the bracket 186 it has an opening therein so that it can be expanded against the interior undercuts 141 and 143 of the outer peripheral channel members such as outer peripheral channels 130 and analogous peripheral channel 150.

During operation, the camming action of the turning of the handle 170 moves the pin 166 in a manner whereby it moves the hook 160 upwardly and downwardly to be received with the undercut. This serves to secure the edge channel portion 106 to the frame 50. A like cam lock 51 secures the edge channel portion 108 to the frame 50.

Figure 3:
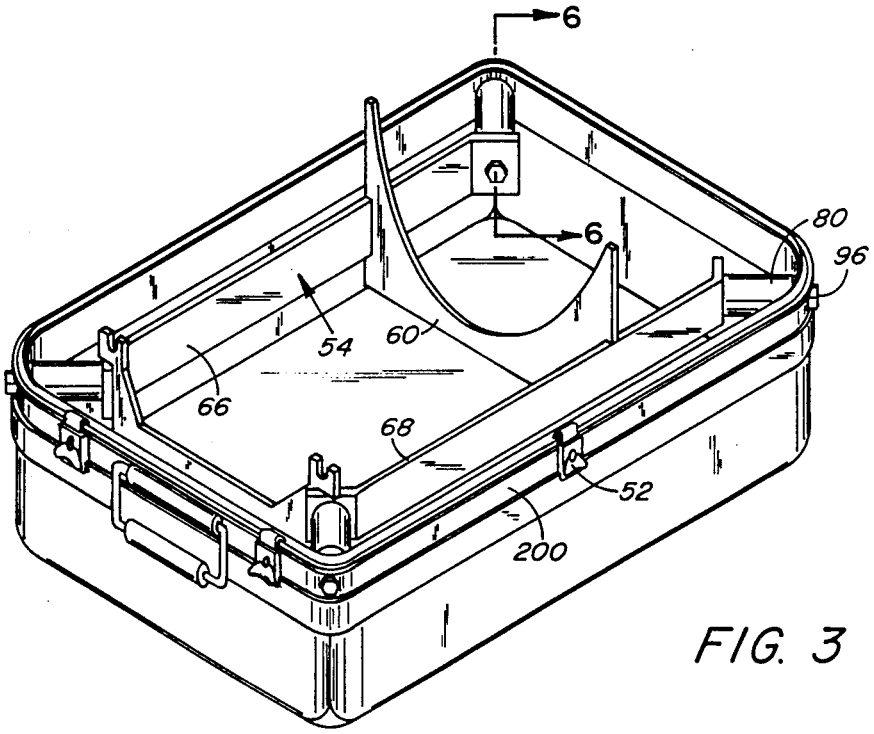
FIG. 3 shows a perspective view of the shock mount frame and the shock mount structure as implaced within a container with the frame forming a portion of the edge closure.
Figure 6:
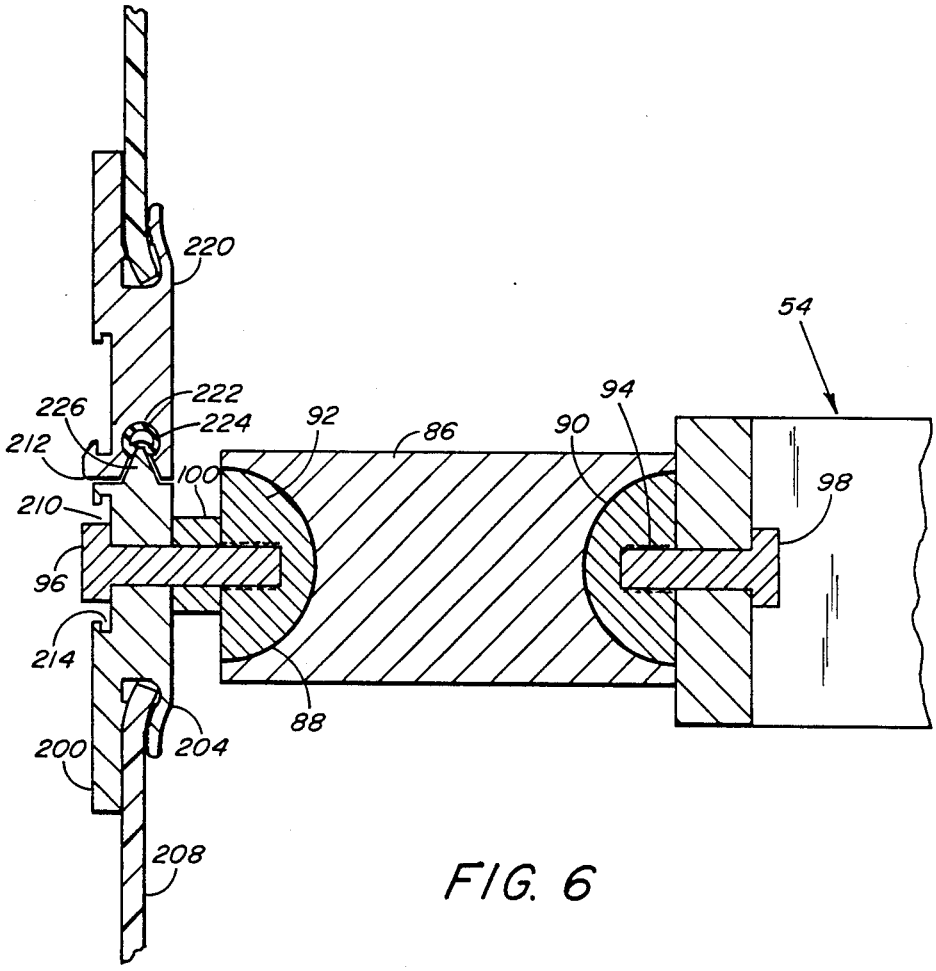
FIG. 6 is a fragmented sectional view as seen in the direction of lines 6—6 of FIG. 3.

Looking more particularly at FIGS. 3 and 6, it can be seen wherein an alternative embodiment is shown. In particular, a shock mount structure or cradle 54 has been shown with the yoke 60 and rails 66 and 68. All the other portions are also analogous or like the prior showings. In particular, the shock mounts 80 are analogous in all respects to the prior showing. However, in this particular instance, the shock mount frame is formed analogous to the lower peripheral channel member 108. In particular, a lower peripheral channel member 200 is shown having a bolt 96 passing therethrough. The lower peripheral channel member 200 has a groove or channel 204 which receives a wall portion 208 of the container shown in FIG. 3. This wall portion is such wherein it is received within the channel 204 in an analogous manner to the receipt of wall portions 110 and 112 which is also detailed in U.S. Pat. No. 4,546,874.

In order to secure the shock mount 80 to the edge channel 200, the bolt 96 pases therethrough and is sealed therein by an adhesive at the interface between the outside dimension of the hole through which the bolt 96 passes so that moisture cannot pass through the space between the bolt 96 and the frame 50. The bolt 96 passes through a peripheral channel 210 having the undercuts 212 and 214 analogous to undercuts 132 and 134 of the prior showings of FIG. 4. In this manner, an overcenter latch, such as latch 51 or 52 can be utilized with the undercuts 212 and 214 to secure the edge channels in sealed relationship.

In the embodiment of FIG. 3, the peripheral edge channel member 200 performs the same function as the frame member 50 as set forth in the prior description. It also serves to receive an edge channel member 220 having a circular channel 222 with a gasket 224 therein, by means of a triangular bead or tongue 226 extending upwardly thereagainst and sealing thereto. Thus, the upper member 220 or edge channel of the container seats effectively against the lower edge channel 200 so that the top and bottom portions of the container can be sealed. At the same time, the edge channel member 200 serves the function of a rigidifying frame to support the shock mount 80 in order to hold the shock mount equipment structure 54 in rigidified contact with the container walls so that when the walls 208 collapse, it does not affect the shock mount structure 54.

In order to allow for various atmospheric and pressure differentials, a two way valve 37 is shown. The two way valve 37 allows for expansion and contraction. For instance, if the container 10 is closed at atmospheric pressure, and then is taken to substantial altitudes so that the pressure decreases, the two way valve allows for outgassing of the pressure in the container 10. In like manner, when the equipment therein is surrounded with an inert gas it allows for the expansion and contraction of the gas in the container.

The shock mount structure 54 which holds equipment to be isolated thereon is supported by the shock mounts 80 in conjunction with the rigid frame 50 or the rigid edge channel 200. It serves to prevent shocks that skew, angularly offset, or in any other manner affect the container walls, such as the plastic container walls, from transmitting shock forces directly into the equipment support structure 54 in as severe a manner as if the shock mounts 80 were directly mounted to the plastic walls.

The frame 50 has been shown with container 10. However, it should be understood that container 10 can be utilized with and without the frame structure 50 and performs a dual function.

The frame structure 50 can be removed from the container 10 and used to service any equipment mounted within or to the shock mount structure 54. Thus, the entire contents that are mounted on the shock mount structure 54 can be moved, serviced, and handled in any other particular manner once removed from the container 10 on the frame 50. This provides for a facile and shock proofed handling of the equipment on the shock mount structure 54 within the frame 50. This thereby enhances the overall retrofitting, handling and multiutilization of the container 10.

From the foregoing, it can be seen that this invention is a broad step over the prior art for purposes of providing shock proof mountings to equipment to be held within plastic or non-rigid containers which are to be maintained interiorly within a moisture proof condition.

I claim:

1. A container for receipt of equipment to be maintained therein wherein said container is formed from two portions that have edge regions thereto to provide a closure wherein the improvement comprises:

a substantially rigid frame member held at the outer portion of said container;

a plurality of individually mounted shock mounts extending from said frame member interiorly thereof in spaced relationship;

means attached to said shock mounts for supporting equipment; and wherein, said shock mounts extend interiorly to place at least a portion thereof under a bending moment.

2. The container as claimed in claim 1 further comprising:

a frame member formed as a portion of said container edge region between the two respective container portions.

3. The container as claimed in claim 2 further comprising:

an edge region of said container portion forming a portion of said frame formed of a channel member receiving a side wall portion of said container and having a portion adapted for mating with a second channel member of the section portion of the container; and wherein, said shock mounts are mounted by threaded members to said first channel member.

4. The container as claimed in claim 3 further comprising:

overcenter cam locks attached to said first channel member and adapted to be attached to the second portion of said container.

5. The container as claimed in claim 4 further comprising:

shock mounts formed as elastomeric members having a metallic portion embedded at either end thereof for receipt of said threaded members for securement of said mounts to said first channel member and said equipment supporting means.

6. The container as claimed in claim 1 further comprising:

a separable frame member formed with means for mating directly between the edge regions of said container and further comprising a gasket adapted for purposes of sealing said container.

7. The container as claimed in claim 5 wherein:

said channel member is sealed by means of a sealant to the edges of said container.

8. A container formed of two separable plastic portions comprising:

a first and second separable plastic portion of said container suited to close upon each other to form a unified container;

channel members on the edge regions of said two respective portions for mating with each other so that said channel members can provide a closure between the two respective portions:

a frame member which is separable from said two respective channel portions which can mate therewith to provide a closed relationshp between said two respective portions;

shock mounts attached interiorly of said frame member to said frame member; and, a cradle structure for holding equipment on said cradle structure and attached to said shock mounts.

9. The container as claimed in claim 8 wherein:

said channel members are metal channel members having a portion for the receipt of the container portion edges and having a respective portion for receipt of the other channel member therein, so that said channel members when brought together at the edge regions of said two respective container portions mate with each other to provide a closed relationship to the interior of said container.

10. The container as claimed in in claim 9 wherein:

one of said channel members has a groove with a gasket therein; and, said other channel member has a protuberance adapted for extending into said groove.

11. The container as claimed in claim 10 wherein:

said frame member has an edge region matching one of said chanel edge regions of said container on one side and a second edge region matching the second channel member of said container on the opposing side.

12. The container as claimed in claim 11 wherein:

said frame member has a cradle structure interiorly thereof mounted to said frame member by means of elastomeric shock mounts.

13. The container as claimed in claim 12 wherein:

said shock mounts comprise elastomeric members having a metallic member set within the elastomer;

means for receiving threaded members within said metallic members set within said elastomer; and, threaded attachment means between said frame and said cradle structure interconnected with said shock mount.

14. A shock mounting for a plastic container having two portions thereof which receives equipment therein to be isolated form the exterior by means of said shock mounting comprising:

a rigidified metal portion adapted for connection to the edge regions of said container portions and substantially extending around the periphery of said container;

an equipment shock mount structure for receiving equipment interiorly of said container; and, means connecting said equipment shock mount structure in the form a plurality of spaced elastomeric shock mounts to said outer rigidified peripheral portion and extending between said shock mount structure and said rigidified metal portion so that said elastomeric shock mounts are at least in part under a bending moment.

15. The container as claimed in claim 14 wherein said outside peripheral rigidified portion comprises:

a channel member forming the edge region of one of said portions of said container.

16. The container as claimed in claim 14 wherein:

said peripheral outside rigid portion comprises a frame extending between the interfacing portion of said container portions.

17. The container as claimed in claim 16 wherein:

said frame has mating portions for receiving the edge regions on either side thereof of said two respective container portions.

18. The container as claimed in claim 17 further comprising:

an equipment shock support structure interiorly of said container having means adapted for receiving elastomeric shock mounts; and wherein, said elastomeric shock mounts comprise elastomeric members having metallic portions embedded therein with thread means to receive threaded connections between said equipment shock mount support structure and said frame.

19. The container as claimed in claim 18 wherein:

said frame includes a channel therein having a gasket for receipt of the edge regions of one of said container portions.

20. The container as claimed in claim 19 further comprising:

a two way valve within the side walls of one of said container portions.

* * * * *